United States Patent [19]

Wilden

[11] 4,339,985

[45] Jul. 20, 1982

[54] AIR DRIVEN RECIPROCATING DEVICE

[75] Inventor: James K. Wilden, Yucaipa, Calif.

[73] Assignee: Wilden Pump & Engineering Co., Inc., Colton, Calif.

[21] Appl. No.: 141,815

[22] Filed: Apr. 21, 1980

[51] Int. Cl.[3] ..... F01L 25/06

[52] U.S. Cl. ..... 91/307; 91/319; 91/329

[58] Field of Search ..... 91/307, 319, 320, 329

[56] References Cited

U.S. PATENT DOCUMENTS 335,855 2/1896 Toole ..... 91/307

3,071,118 1/1963 Wilden ..... 91/307

3,548,716 12/1970 Rayl ..... 91/307

*Primary Examiner*—Paul E. Maslousky

*Attorney, Agent, or Firm*—Lyon & Lyon

[57] ABSTRACT

An actuator valve for an air driven reciprocating device wherein the valve includes a control rod responsive to movement of the reciprocating device and a valve piston pneumatically actuated by movement of the control rod. The valve piston selectively directs air to reciprocate the driven mechanism. The control rod includes dual axial passageways to selectively vent each end of the cylinder within which the valve piston operates. The passageways are sealed such that unused pressurized air will not escape from the air valve.

3 Claims, 6 Drawing Figures

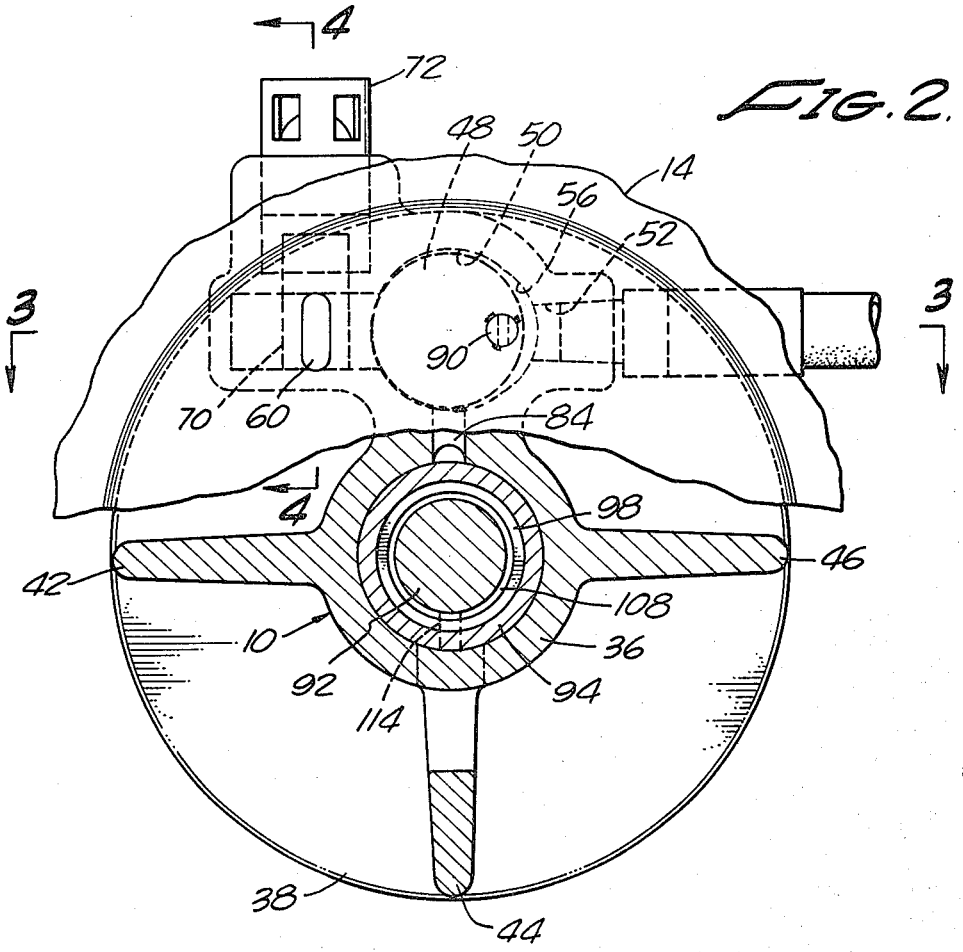
FIG. 2.
FIG. 3.
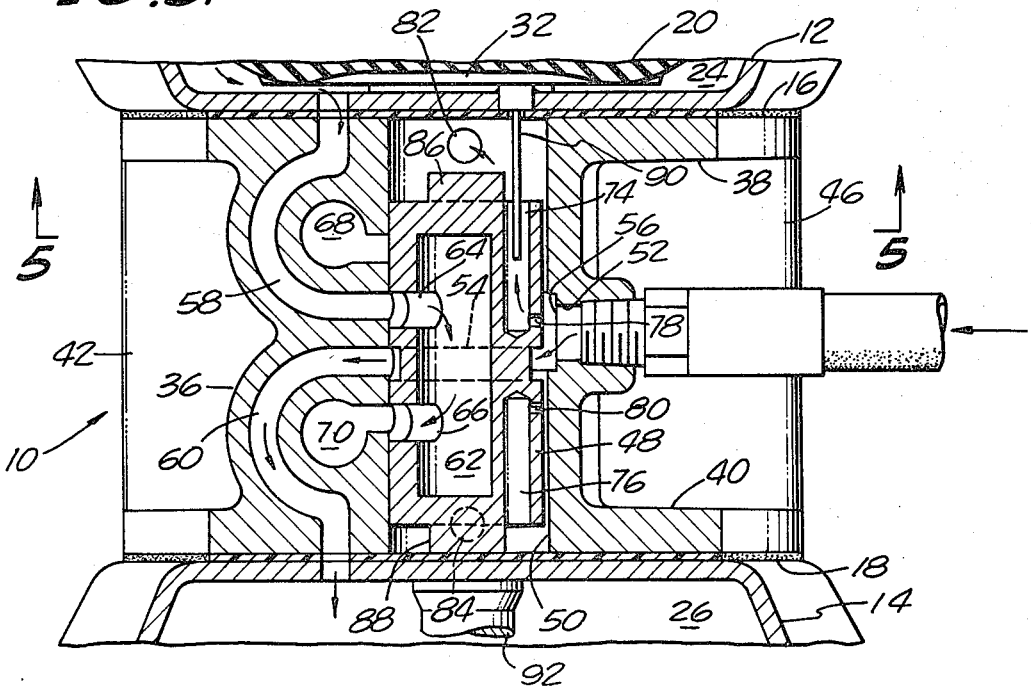

AIR DRIVEN RECIPROCATING DEVICE

BACKGROUND OF THE INVENTION

The present invention is directed to actuator valves for air driven reciprocating devices. More specifically, the present invention is directed to an actuator valve for reciprocating devices wherein the valve includes a control rod which reciprocates with the driven mechanism and a pneumatically controlled valve piston.

Actuator valves for reciprocating pneumatically driven devices have been developed which employ a pilot valve or rod responsive to the position of the reciprocating element of the device and a pneumatically controlled valve piston responsive to the pilot rod position. The valve piston in turn controls the incoming flow of pressurized air to provide an alternating flow to the reciprocating element. This alternating flow forces the element to stroke back and forth thereby performing work and driving the pilot rod. Such actuator valves thus convert a relatively steady source of pressurized air into an alternating flow without need for any outside timing or control system. The source air pressure alone drives the valve as well as the working device.

One such actuator valve used primarily on air driven diaphragm pumps is disclosed in U.S. Pat. No. 3,071,118, the disclosure of which is incorporated herein by reference. This pump system has included air driven diaphragms positioned on either side of an actuator valve in an arrangement substantially identical, outwardly of the actuator valve and pilot or control rod, to the pump shown in FIG. 1 herein. In the earlier actuator valves employed with these pumps, the valve piston has been oriented vertically and the pilot rod has included two axial passages for selectively venting the appropriate ends of the chamber within which the valve piston is to operate. Vents for the axial passages have been positioned outwardly of the valve piston vents along the passageway through which the control rod extends. In this way each axial passage on the control rod vents one end of the cylinder within which the valve piston operates through inward movement of one of the axial passages on the control rod until that axial passage becomes exposed to a valve piston vent. To accommodate this operation, the rod and its path of travel through the actuator valve is exposed to the pressurized air of the system. Another control rod and vent arrangement is disclosed in co-pending patent application, Ser. No. 38,685, filed May 14, 1979, now U.S. Pat. No. 4,242,941, the disclosure of which is incorporated herein by reference.

Normally the control for both the actuator valve and the pump it drives is through control of the air supply driving the device. However, when close control of the pump output is required, many users have found that the pump output may be valved and the air pressure to the device left on. As a result, the pump is stalled or approaches a stalled condition as the output is cut back or closed off. Pressurized air remains, in this stalled condition, in the valve piston cylinder and in one of the two pump air chambers.

Heretofore, the actuator valves of the type disclosed in U.S. Pat. No. 3,071,118 would use air which did not perform useful work in either operating the valve or in driving the associated reciprocating device. This air escaped from the actuator valve by the control rod. When the pump was in either the stalled condition or near stalled condition, the loss of air became noticeable and in some applications objectionable. Particular attention has also been directed to this wasting of pressurized air because of the resulting waste of energy. Furthermore, in the stalled condition, the wasted air detracted from the power available to the associated reciprocating device.

SUMMARY OF THE INVENTION

The present invention is directed to an improvement on the commercial application of the actuator valve disclosed in U.S. Pat. No. 3,071,118. New passageway and gating for the control rod have been designed which allow the central portions of the control rod passageway to be isolated from the air chambers of the reciprocating device. This is accomplished by employing a combination of O-rings in the control rod passageway which isolates the pressurized air of both the pump air chambers and the actuator valve from the control rod vents. In this way, a continuous seal is maintained against the reciprocating control rod.

By providing the new O-ring pattern in the control rod passageway, air from the air chamber of the working device cannot pass to exhaust along the control rod at any time during the operation of the device except where desired through the axial passages in the control rod designed for that purpose. Provision is made for sealing means at the outer ends of the passageway for the control rod. These sealing means are of sufficient length to prevent bridging of the sealing means by the axial passages on the control rod. Thus, there remains no direct path from the air chambers of the associated reciprocating device except as controlled through the valve piston of the actuator valve.

The O-ring arrangement is advantageous for preventing the escape of unused pressurized air and therefore energy from the actuator valve when pressure is communicated to the valve. This advantage is of particular importance when the valve is used with an output controlled pump where air usage has previously been experienced with the pump stopped. The lack of leakage at stall becomes even more important when the reciprocating device carries a load approaching the stall point. With such a pneumatic device, the available power is limited to the pressure of the compressed air. If leakage is experienced, the available power is reduced by these losses and stall can occur. This is also advantageous in the use of diaphragm pumps because the diaphragms are necessarily made of flexible material and tend to wear out faster than the remaining parts of the device. When these diaphragms fail, they develop cracks through which the material being pumped can pass. As much of the material being pumped in practical applications of these pumps is abrasive or corrosive, adverse effects are experienced by the actuator valve when this material is able to reach the internal portions of the actuator valve. Such a condition has been deterred by the sealing of the control rod passageway in the present invention.

Accordingly, it is an object of the present invention to provide an improved actuator valve for an air driven reciprocating device. Other and further objects and advantages will appear hereinafter.

BRIEF DESCRIPTION OF THE DRAWINGS

FIG. 2 is a cross-sectional view taken along line 2—2 of FIG. 1.

FIG. 3 is a cross-sectional view taken along line 3—3 of FIG. 2.

DETAILED DESCRIPTION OF THE PREFERRED EMBODIMENT

Figure 1:
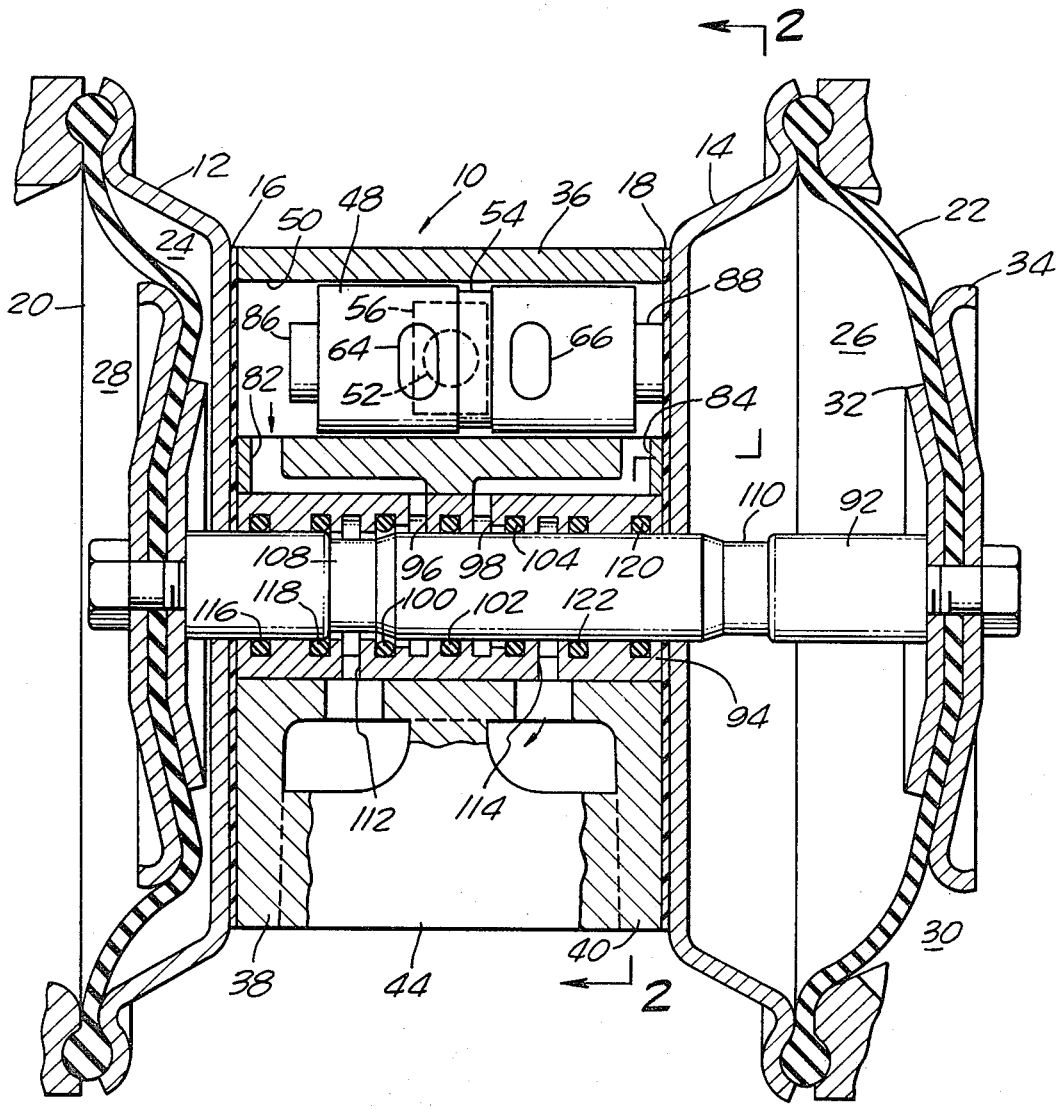
FIG. 1 is a cross-sectional elevation of the actuator valve of the present invention shown in assembly with the diaphragms of an air driven diaphragm pump.

Turning in detail to the drawings, FIG. 1 illustrates the actuator valve of the present invention in conjunction with fragmented portions of an air driven diaphragm pump. The actuator valve, generally designated 10, includes a housing, a valve piston positioned in the housing and a control rod extending through the housing.

The actuator valve 10 is positioned between opposed pump cavities with which it cooperates. One overall configuration of an air driven diaphragm pump which may be associated with the actuator valve of the present invention is illustrated in co-pending patent application Ser. No. 29,619, filed Apr. 13, 1979. The physical positioning of the major components as in U.S. Pat. No. 3,071,118, such as a vertically oriented valve piston, is also a preferred design which may be employed with the present invention. Drive chamber housings 12 and 14 abut the sides of the actuator valve 10 with appropriate gaskets 16 and 18 therebetween. Circular diaphragms 20 and 22 are associated with the drive chamber housings 12 and 14 to form air chambers 24 and 26. Outwardly of the diaphragms 20 and 22 are pump chamber housings 28 and 30. Piston assemblies are located about the center of each of the diaphragms 20 and 22 and each include an inner plate 32 and an outer plate 34 between which the diaphragms 20 and 22 are sandwiched. The inner plate 32 and outer plate 34 of each of the piston assemblies is associated with the control rod of the actuator valve 10 as can best be seen in FIG. 1.

In the context of the air driven diaphragm pump illustrated in FIG. 1, the actuator valve 10 provides a source of alternating pressurized air and exhaust to each of the air chambers 24 and 26. The diaphragms move as a unit because of the rigid coupling provided by the control rod and piston assemblies. The actuator valve 10 supplies pressurized air to one air chamber while exhausting the other air chamber to drive one diaphragm outwardly toward an adjacent pump cavity and to pull the other diaphragm inwardly away from another adjacent pump cavity. In this way, there is an intake stroke in the right pump cavity and a pump stroke on the left pump cavity as the diaphragms move left. At the end of the stroke, the actuator valve reverses the flow and the pump functions are reversed as the diaphragms are forced to move to the right.

Looking then specifically to the actuator valve 10, a unitary casting is employed in the preferred embodiment as a housing 36. The housing 36 includes two parallel mounting plates 38 and 40 having flat outer surfaces for mating with the drive chamber housings 12 and 14. The cross-section of the actuator 10 inwardly of the mounting plates 38 and 40 is best seen in FIG. 2. Strengthening webs 42, 44 and 46 extend between the mounting plates 38 and 40. In the upper portion of the casting are located the air inlet, the valve piston and the means for directing air into and out of the reciprocating device. Centrally located in the housing 36 is the control rod and bushing.

The valve piston 48 is positioned in a cylinder 50 formed within the housing 36. The valve piston 48 and cylinder 50 cooperate to provide two major functions. The first is to provide means for selectively directing incoming air to either air chamber 24 and 26 and exhausting the opposite chamber in an alternating manner. The valve piston 48 and cylinder 50 also cooperate to provide a means for directing incoming air to the ends of the valve piston 48 such that the piston is capable of shifting in response to the position of the reciprocating device. To accomplish these functions, the air inlet 52 is directed to the cylinder at a central position spaced from the ends of the cylinder as can best be seen in FIGS. 2 and 3.

Figure 4:
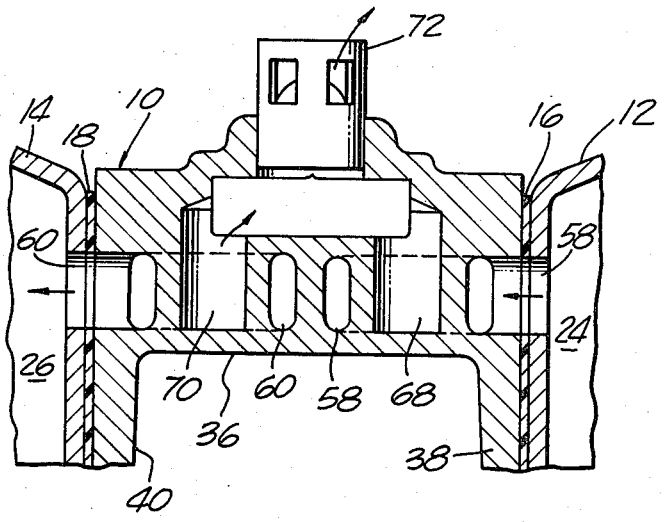
FIG. 4 is a cross-sectional view taken along line 4—4 of FIG. 2.
Figure 5:
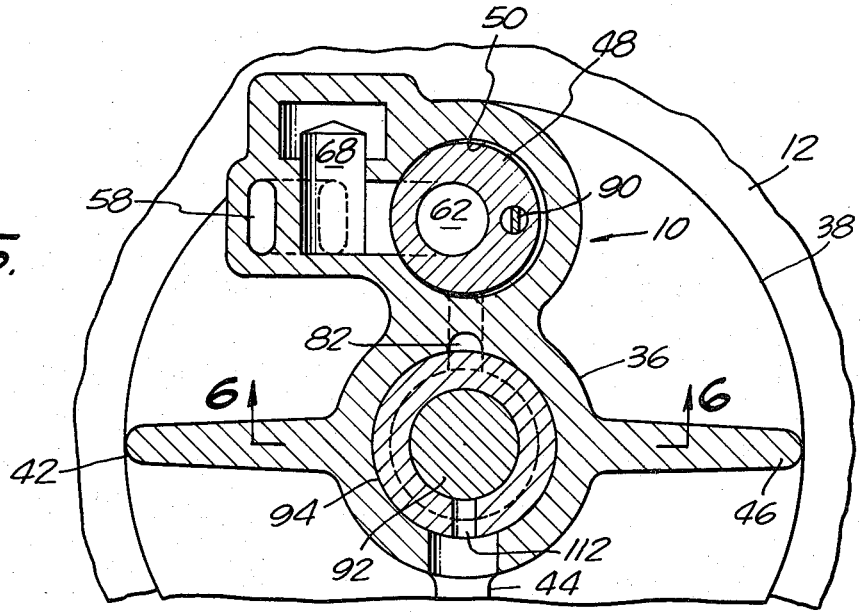
FIG. 5 is a cross-sectional view taken along line 5—5 of FIG. 3.
Figure 6:
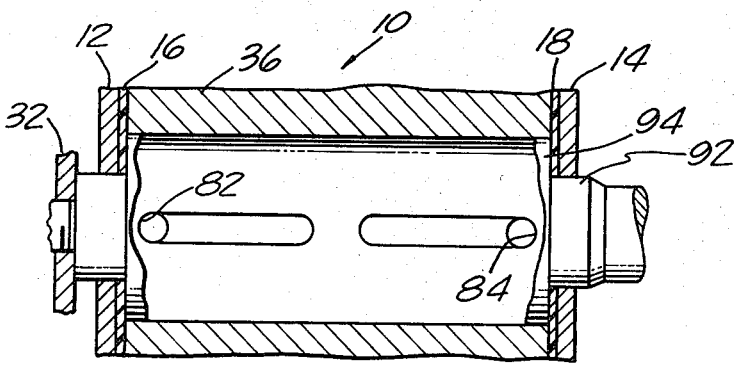
FIG. 6 is a cross-sectional view taken along line 6—6 of FIG. 5 with a portion of the control rod bushing broken out for clarity.

In providing a means for charging and exhausting the air chambers of the reciprocating device, the valve piston 48 includes an annular groove or channel 54 which cooperates with an arcuate passage 56 cut in the side of the cylinder 50 to direct air to one or the other of two air chamber ducts 58 and 60 as best seen in FIG. 3. With the channel 54 aligned with the air chamber duct 58, incoming air will pass through the air inlet 52, the arcuate passage 56, the channel 54 and into the air chamber duct 58. Each of the air chamber ducts 58 and 60 is aligned with a hole through the wall of the drive chamber housings 12 and 14. While air is entering one of the ducts 58 and 60, the other duct will operate as an exhaust passage. A cavity 62 exists in the center of the valve piston 48. This cavity 62 enables the air flowing through the exhausting duct to flow through the cavity 62 and through ports 64 and 66 to one of two exhaust ducts 68 and 70. The exhaust ducts 68 and 70 extend to a ball check valve 72 as can best be seen in FIG. 4. When the valve piston 48 is shifted from one end to the other of the cylinder 50, the flow through the air chamber ducts 58 and 60, the cavity 62 and the ports 64 and 66 is reversed. The shift in the valve piston 48 also causes one of the exhaust ducts 68 and 70 to become blocked off while the other is opened for exhausting the alternate one of the air chambers 24 and 26.

The second main function performed by the valve piston 48 and cylinder 50 is the control of the location of the valve piston 48. To this end, the valve piston 48 has a diameter which is slightly smaller than the diameter of the cylinder 50. Thus, air is able to flow in the clearance to both ends of the valve piston 48 regardless of its position in the cylinder 50. This clearance is not illustrated in the figures for simplicity. There are also two axial paths allowing a greater amount of air to selectively flow to one end or the other of the valve piston 48. These axial paths each include a bore 74 and 76 and a hole 78 and 80 drilled into the respective bore. The holes 78 and 80 are spaced such that the distance from inside edge to inside edge is the same as the width of the arcuate passage 56. Thus, only one of the holes 78 and 80 may be exposed directly to the incoming air in the arcuate passage 56 at one time. This selective direction of air through the holes 78 and 80 provides an effective anti-stall feature better described in the earlier U.S. Pat. No. 3,071,118.

To initiate the shifting of the valve piston 48, one or the other of two valve piston vent passages 82 and 84 is vented to atmosphere. These vent passages are located at the ends of the cylinder 50 as can be seen in FIG. 3.

During normal operation, the vent passage at the end furthest from the valve piston 48 is vented. The valve piston 48 then moves toward that vented end of the cylinder. During the stroke of the air driven reciprocating device associated with the actuator valve 10, neither end of the cylinder 50 is vented. It is only at each end of the working stroke that venting takes place.

During the working stroke of the air driven reciprocating device, air flows through the clearance between the valve piston 48 and the cylinder 50 and through one of the axial paths in the valve piston 48. Once pressure has built up at both ends, there is substantially no flow axially in the cylinder 50. Two bosses 86 and 88 form spacers on either end of the valve piston 48 such that an annular air space is created at the ends of the valve piston 48. This air space has been referred to as a shift chamber and acts as a potential energy storage mechanism to effect the shifting of the valve piston 48.

The cylinder and valve piston tolerance and air passage dimensions are such that the ends of the cylinder 50 may be vented much faster than they are replenished with incoming pressurized air. Thus, when venting occurs at one end of the valve piston chamber 50, a pressure imbalance is experienced by the valve piston 48. The shift chamber at the unvented end of the valve piston 48 has a reservoir of compressed air such that the venting of the other end releases the air spring to drive the valve piston 48 to the vented end of the cylinder. Once the valve piston 48 reaches just past half way in its shift through the cylinder 50, the shifting is aided by the axial path of the valve piston 48 extending to the unvented end of the cylinder 50. This mechanism insures a complete shift.

The incoming pressurized air also acts to force the valve piston 48 against the opposite side of the cylinder. This is accomplished even during low flow conditions because the ports 64 and 66 are vented. With these areas of lower pressure, a pressure imbalance is created such that the inlet air pressure will hold the piston against the opposite wall. This biasing of the piston is beneficial because the axial paths created by the valve piston clearance is more uniform and the valve piston can thus seal the air chamber ducts 58 and 60 and exhaust ducts 68 and 70 where appropriate.

The valve piston is contained within the cylinder 50 by means of the drive chamber housings 12 and 14 which define the ends of the valve piston chamber 50. Furthermore, a pin 90 extending into the bore 76 maintains the angular orientation of the valve piston 48.

To achieve the shifting of the valve piston 48 at the appropriate time, a control rod 92 is used. The control rod is fixed to reciprocate with the air driven reciprocating device by either a direct attachment or some conventional form of linkage. The control rod is positioned in a passageway through the housing 36. The control rod 92 further extends into the air chambers 24 and 26 to retain the diaphragm pistons at a fixed spaced distance from one another and in alignment. A bushing 94 fixed to the housing 36 and forming part of the housing provides a guide for the control rod 92.

The valve piston vent passages 82 and 84 extend from the ends of the cylinder 50 to circular grooves 96 and 98. On either side of each of the circular grooves 96 and 98 are circular seats which each contain an O-ring seal 100 through 104 to seal these circular grooves 96 and 98.

The control rod 92 includes axial passages 108 and 110. The axial passages 108 and 110 include truncated conical sections with a central cylindrical section having a reduced diameter from the main body of the control rod 92. These axial passages 108 and 110 are positioned near the ends of the control rod 92 and an appropriate distance apart to provide a proper stroke to the pump. When either of the inner O-rings 100 and 104 are encountered, air communication between the valve piston vent passages 82 and 84 and the axial passage 110 is achieved. The O-ring 102 provides a seal between circular grooves 96 and 98.

Outwardly of the inner O-rings 100 and 104, two control rod vent passages 112 and 114 extend to atmosphere. The O-rings 100 and 104 seal the valve piston vents 82 and 84 from the control rod vent passages 112 and 114 except when the axial passages 108 and 110 span these O-rings. Shifting of the valve piston 48 occurs when the O-rings 100 and 104 are bridged.

Outwardly of the control rod vent passage 112, O-rings 116 and 118 are positioned and spaced to insure that the axial passage 108 cannot bridge both O-rings at once. An identical arrangement is provided at the other end of the control rod passageway by O-rings 120 and 122. Thus, a constant seal is maintained to deter any matter from entering into the bushing 94 from the air chambers 24 and 26 and to prevent air leakage to the control rod vent passages 112 and 114.

Through the use of the O-ring arrangement disclosed, there is no direct loss of pressurized air through open seals. Thus, the air actually needed to fill the air chambers 24 and 26 to move the diaphragms 20 and 22 and the air needed to shift the valve piston 48 is substantially all that is used by the present device.

In overview, the operation of the actuator valve is in the nature of a feedback control system. That is, the location of the valve piston 48 determines the movement of the air driven reciprocating device. The movement of the air driven reciprocating device in turn controls the location of the control rod 92. The control rod location determines the position of the valve piston. The control of the stroke of the air driven reciprocating device is by the spacing of the axial passages 108 and 110.

Thus, an improved actuator valve for an air driven reciprocating device is disclosed. While embodiments and applications of this invention have been shown and described, it would be apparent to those skilled in the art that many more modifications are possible without departing from the invention concepts herein described. The invention, therefore is not to be restricted except by the spirit of the appended claims.

What is claimed is:

1. An air driven reciprocating device having air chambers and diaphragms, a valve piston, a control rod having ends fixed to said diaphragms of the air driven reciprocating device, two axial passages in said control rod, and a housing having a cylinder closed at each end and enclosing said valve piston, a passageway through which said control rod extends, a first one of said air chambers of the reciprocating device being adjacent a first end of said control rod passageway and a second one of said air chambers of the reciprocating device being adjacent a second end of said control rod passageway, an air inlet to said cylinder spaced from the ends of said cylinder, valve piston vent passages extending from the ends of said cylinder to said passageway, and control rod vent passages extending from said passageway to atmosphere, said control rod vent passages intersecting said passageway outwardly of said valve piston vent passages, said valve piston cooperating with said housing to include means for directing incoming air to the ends of said valve piston and means for selectively directing incoming air to and exhausting outgoing air from said air chambers of the air driven reciprocating device, wherein the improvement comprises a seal in said passageway near each end thereof, said seals each being wider axially along said passageway than the length of each of said axial passages in said control rod, each said seal including two shaft sealing elements spaced axially along said passageway at a distance greater than the length of each said axial passage in said control rod.

2. The actuator valve of claim 1 wherein the improvement further comprises said shaft sealing elements each being an O-ring.

3. An air driven reciprocating device having air chambers and diaphragms, comprising an combination a valve piston, a control rod having ends fixed to said diaphragms of the air driven reciprocating device, a housing having a cylinder closed at each end and enclosing said valve piston, a passageway through which said control rod extends, a first one of said air chambers of the reciprocating device being adjacent a first end of said control rod passageway and a second one of said air chambers of the reciprocating device being adjacent a second end of said control rod passageway, an air inlet to said cylinder spaced from the ends of said cylinder, valve piston vent passages extending from the ends of said cylinder to said passageway, and control rod vent passages extending from said passageway to atmosphere, said valve piston cooperating with said housing to include means for directing incoming air to ends of said valve piston and means for selectively directing incoming air to and exhausting outgoing air from said air chambers of the air driven reciprocating device, axial passages in said control rod positioned outwardly of said valve piston vent passages to vent selectively each of said valve piston vent passages to said control rod vent passages and sealing means outwardly of said control rod vent passages in said passageway, said control rod vent passages intersecting said passageway outwardly of said valve piston vent passages and each said sealing means being wider than each said axial passage in said control rod, each said sealing means including two shaft sealing elements spaced axially along said passageway at a distance greater than the length of each said axial passage in said control rod.

* * * * *